US012022904B2

(12) United States Patent
Mazzarolo et al.

(10) Patent No.: US 12,022,904 B2
(45) Date of Patent: Jul. 2, 2024

(54) PROTECTIVE HELMET

(71) Applicant: ALPINESTARS RESEARCH S.P.A., Maser (IT)

(72) Inventors: Giovanni Mazzarolo, Coste di Maser (IT); Roberto Parissenti, Sedico Belluno (IT)

(73) Assignee: ALPINESTARS RESEARCH S.P.A., Maser (IT)

( * ) Notice: Subject to any disclaimer, the term of this patent is extended or adjusted under 35 U.S.C. 154(b) by 343 days.

(21) Appl. No.: 17/617,371

(22) PCT Filed: Jun. 17, 2020

(86) PCT No.: PCT/EP2020/066770

§ 371 (c)(1),
(2) Date: Dec. 8, 2021

(87) PCT Pub. No.: WO2020/254411

PCT Pub. Date: Dec. 24, 2020

(65) Prior Publication Data

US 2022/0248792 A1 Aug. 11, 2022

(30) Foreign Application Priority Data

Jun. 18, 2019 (IT) ..... 102019000009369

(51) Int. Cl.
*A42B 3/06* (2006.01)
*A42B 3/12* (2006.01)

(52) U.S. Cl.
CPC ..... *A42B 3/064* (2013.01); *A42B 3/125* (2013.01)

(58) Field of Classification Search
CPC .. A42B 3/10; A42B 3/12; A42B 3/064; A42B 3/125; A42B 3/06
See application file for complete search history.

(56) References Cited

U.S. PATENT DOCUMENTS 4,710,984 A 12/1987 Asper et al.
2004/0168246 A1 9/2004 Phillips
(Continued)

FOREIGN PATENT DOCUMENTS

CN 108955385 A 12/2018
EP 2526799 A1 11/2012
(Continued)

OTHER PUBLICATIONS

PCT International Search Report and Written Opinion dated Aug. 26, 2020 for Intl. App. No. PCT/EP2020/066770, from which the instant application is based, 10 pgs.
(Continued)

*Primary Examiner* — Richale L Quinn
(74) *Attorney, Agent, or Firm* — Fredrikson & Byron, P.A.

(57) ABSTRACT

Protective helmet (1) designed to be worn by a user and to protect the head (H) of the user during an impact. The protective helmet (1) comprises a rigid outer shell (6) and a comfort liner (10) having an inner surface (18), designed to be in contact with the user's head (H) when the helmet (1) is worn by the user, and an outer surface (20), opposite to the inner surface (18). The helmet (1) further comprises an impact absorbing liner (8) interposed between the rigid outer shell (6) and the comfort liner (10) and having an inner surface (22) facing the outer surface (20) of the comfort liner (10). The inner surface (22) of the impact absorbing liner (8) comprises at least one layer (36) made of an epoxy resin in contact with the comfort liner (10) in use.

12 Claims, 4 Drawing Sheets

(56) References Cited

U.S. PATENT DOCUMENTS

| | | | |
|---|---|---|---|
| 2006/0059605 | A1 | 3/2006 | Ferrara |
| 2011/0135825 | A1 | 6/2011 | Lee |
| 2016/0113346 | A1 | 4/2016 | Lowe |
| 2019/0000175 | A1 | 1/2019 | Shaffer et al. |

FOREIGN PATENT DOCUMENTS

| | | | |
|---|---|---|---|
| EP | 2896308 | A1 | 7/2015 |
| EP | 3986193 | B1 | 4/2022 |
| GB | 2434303 | A | 7/2007 |
| WO | 2005000059 | A1 | 1/2005 |
| WO | 2013102834 | A1 | 7/2013 |
| WO | 2016048497 | A1 | 3/2016 |
| WO | 2017148958 | A1 | 9/2017 |
| WO | 2020254411 | A1 | 12/2020 |

OTHER PUBLICATIONS

Electrolube, "Technical Data Sheet: ER2183 Epoxy Resin", Electrolube, 2005, pp. 1-3.
Electrolube, "Encapsulation Resins Technical Data Sheet: ER1448 Epoxy Resin", Electrolube, 2013, pp. 1-3.
Pro-Power, "Epoxy Resin EGPE500GF", Feb. 7, 2014, pp. 1-4.
"Notice of Opposition re European Patent No. 3986193", dated Mar. 7, 2024, pp. 1-25.
Performance Composites Inc., "Designing with Fiberglass", Retrieved from web Apr. 5, 2024, pp. 1-8.

PROTECTIVE HELMET

RELATED APPLICATIONS

This application is a 35 U.S.C. 371 national stage filing from International Application No. PCT/EP2020/066770, filed Jun. 17, 2020, which claims priority to Italian Application No. 102019000009369, filed Jun. 18, 2019, the teachings of which are incorporated herein by reference.

The present invention relates to a protective helmet adapted to be worn by a user for protecting the head in case of an impact. In particular, even though not exclusively, the present invention relates to a helmet suitable for being used in motorcycling, skiing, cycling and other similar sports wherein a protection for the head of the user is needed.

For simplicity's sake, in the continuation of the description reference will be made to a motorcycling helmet, preferably a motocross helmet.

As well known in the art, motorcycling helmets comprise a series of overlapping layers fixed there between and made of different materials, each of which has a specific function.

In particular, such helmets can comprise an outer shell made of a synthetic rigid material, an inner comfort liner intended to be placed in contact with the user's head when the helmet is worn and an impact absorbing liner positioned between the outer shell and the comfort liner.

Thus, the arrangement of the helmet layers from the outside towards the inner space of the helmet designed for housing the head envisages the outer shell, the impact absorbing liner and the comfort liner.

The outer shell can be made of a composite or thermoplastic material chosen in the group comprising polycarbonate, ABS, PVC, glass fiber, carbon fiber or Kevlar and is designed to be the first surface receiving an impact coming from outside in order to distribute the impact force.

The impact absorbing liner can be made of an expanded material, as for example EPS (expanded polystyrene), EPU (expanded polyurethane), EPP (expanded polypropylene) or other collapsible materials.

Further, the impact absorbing liner is designed to be fixed to the inner side of the outer shell for absorbing the force of the impact. In particular, the materials of the impact absorbing liner are designed to absorb the impact through a considerable plastic deformation until they are flattened for 50% or more of their normal thickness.

Further, the comfort liner can be made of a soft material, as for example foam, textile or fabric and its function is that of allowing the helmet to rest comfortably on the head of the wearer. The comfort liner can be fixed, either removably or stably, to the impact absorbing liner by suitable fixing means.

As it is known, these helmets are intended for protecting the user's head against blows or impacts, including radial impacts, tangential impacts or oblique impacts.

In particular, radial impacts occur when an external force hits the outer shell along a radial direction, while the tangential impacts occur when an external force hits the outer shell along a direction tangential to the outer surface of the shell.

The radial and tangential impacts are very rare and result, respectively, in a linear acceleration or in a rotational acceleration applied to the helmet, and thus to the head of the user.

Linear acceleration might cause skull fracture, epidural hematoma and translational acceleration of the brain, while rotational acceleration might cause the brain to rotate within the skull. Rotation of the brain might result in injuries, like concussion, diffuse axonal injury (DAT), subdural hematoma, contusion and intracerebral hematoma.

The oblique impacts occur when the force hitting the helmet is the vector sum of a normal (radial) force and a tangential force and are the most common type of impacts. As a matter of fact, the oblique impacts result in a combination of linear acceleration and rotational acceleration.

In order to improve the capacity of absorbing impacts, in particular radial impacts, there have been provided helmets which comprise an additional layer positioned between the impact absorbing liner and the comfort liner.

As an example, such a kind of helmets is described in EP0166691 and the additional layer can be made of PVC (polyvinylchloride), ABS (acrylonitrile butadiene styrene), PEI P (polyethylene terephthalate), PC (polycarbonate), polyamide, PMMA (poly(methyl methacrylate) or PS (polystyrene).

Even if these helmets manage to improve the impact absorption capacity relative to the known helmets, they are not devoid of drawbacks.

In particular, a drawback of these helmets consists in that they do not allow to efficiently absorb the force of oblique impacts, and thus they do not manage at all to avoid rotational acceleration of the brain.

This drawback derives from the fact that the head of the user would remain fully stationary with respect both to the impact absorbing liner and to the outer shell in case of oblique impact.

Another drawback of this solution consists in that the improvement in absorbing radial impacts is not so remarkable with respect to the helmets known in the art.

Further, new helmets have been conceived having a sliding facilitator positioned between the impact absorbing liner and an attachment device, used for attaching the helmet to the user's head and in contact with the head. An example of these new helmets is disclosed in EP2896308.

In this kind of helmets, the sliding facilitator can be fixed to the impact absorbing liner or to the attachment device and allows the sliding there between in order to better control the absorption of the force deriving from oblique impacts, thereby avoiding the rotational acceleration of the brain inside the skull.

For this purpose, the sliding facilitator is made of a material having a low friction coefficient, or can be coated with a low friction material, in particular PTFE (polyethylene terephthalate), ABS, PVC, PC, nylon or fabric materials.

The sliding facilitator can be integrated with the impact absorbing liner or the attachment device by moulding or can be fixed to the impact absorbing liner or to the attachment device using at least one fixation member.

However the helmet disclosed in EP2896308 is not devoid of some drawbacks. First of all, such a technical solution cannot be easily implemented in the helmets described above and provided with the additional layer for improving the absorption of radial impacts.

A further drawback of this solution consists in that the improvement in absorbing radial impacts is not so remarkable relative to the helmets known in the art.

Another drawback of this technical solution consists in that the structure of the helmet is more complex than the known helmets, and thus even more expensive.

Another drawback of this solution is that the attachment device or the impact absorbing liner provided with the sliding facilitator cannot be used with pre-existing helmets.

An object of the present invention is to provide a protective helmet by which the above mentioned drawbacks are solved.

In particular, an aim of the present invention is to provide a helmet which allows to effectively absorb the forces of radial impacts hitting the helmet.

Another aim of the present invention is to provide a helmet which allows an effective absorption of the forces of radial impacts and a partial absorption of the forces of oblique impacts.

A further aim of the present invention is to provide a protective helmet which allows to reduce the linear acceleration the helmet normally undergoes upon receiving a radial impact and partly the rotational acceleration the helmet normally undergoes upon receiving an oblique impact.

These and other objects and aims are achieved by a helmet as claimed in claim 1 and by respective methods for the manufacturing thereof according to claims 11 and 12.

The advantages and the characteristic features of the invention will appear more clearly from the following description of a preferred, but not exclusive, embodiment of a protective helmet with reference to the accompanying figures in which.

With reference to the attached figures, a helmet designed to be worn by a user and to protect the head of the user according to the present invention is indicated as a whole with reference number 1.

The helmet is suitable to be used in particular by motorcyclists, specifically by motocross riders. Nevertheless, as it will appear from the following description, the helmet could be advantageously used by cyclists, skiers, or in other fields where an effective protection of the user's head is needed.

As known, the helmet delimits an inner space for the insertion of the user's head H and the inner space 2 is in communication with the outside through a front opening 4 when the helmet is worn.

Figure 2:
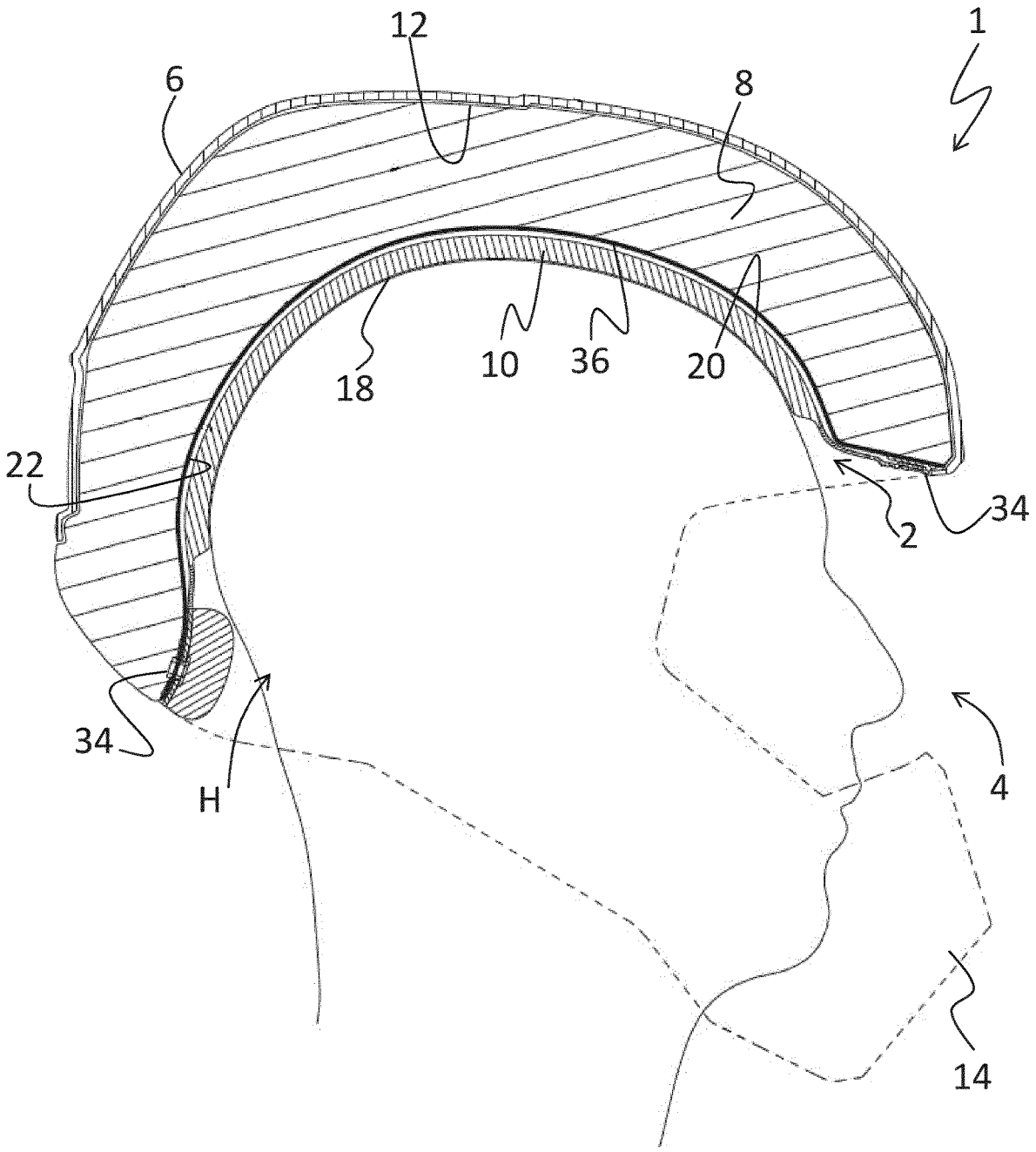
FIG. 2 shows a cross-sectioned side view of the helmet of FIG. 1, wherein the base of the helmet is shown in phantom lines.

For the purpose of the present description, the helmet 1 is intended to be worn in the right way by the user, namely with the front opening 4 positioned at the face of the user for allowing him/her to view through the opening 4, as shown in FIG. 2.

In a preferred embodiment better shown in FIG. 2, the helmet 1 comprises, from the outside towards the inner space 2, a rigid outer shell 6, an impact absorbing liner 8 and a comfort liner 10. Also, the helmet 1 of FIG. 3 comprises a comfort liner 10, even if it is not shown.

Preferably, the helmet 1 may further comprise attachment means, not shown in the figures, for attaching the helmet 1 to the user's head H, as for example well known chin straps.

Advantageously, the impact absorbing liner 8 can be permanently fixed to the inner surface 12 of the outer shell 6, and the comfort liner 10 can be removably coupled to the impact absorbing liner 8 as better explained hereinafter.

The impact absorbing liner 8 can be fixed to the inner surface 12 of the outer shell 6 either by means of an adhesive, as widely known in the art, or by injecting the impact absorbing liner 8 over the inner surface 12 of the outer shell 6.

Further, the outer shell 6 is designed to be the first to receive an impact coming from outside in order to distribute the impact force on a larger portion of the helmet 1.

For this reason, the material of the outer shell 6 is a composite or thermoplastic material and can be chosen in the group comprising polycarbonate, ABS, PVC, glass fiber, carbon fiber or Kevlar.

Figure 1:
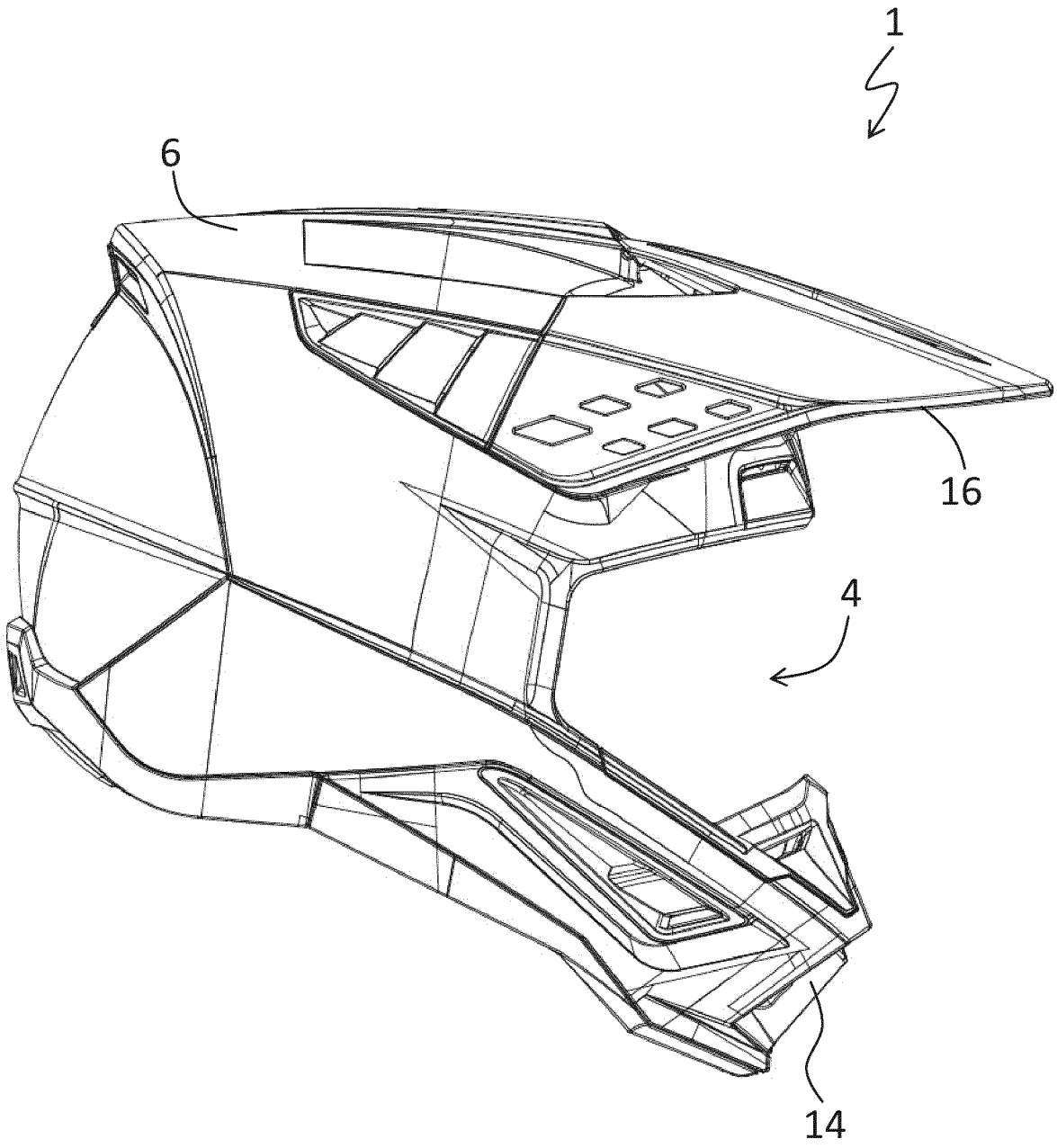
FIG. 1 shows a side view of the helmet according to the present invention.

As better shown in FIG. 1, the outer shell 6 may comprise a chin guard 14 and a visor 16. The chin guard 14 is preferably integral with the rest part of the outer shell 6, while the visor 16 can be removably coupled to the outer shell 6 by suitable fastening means, not shown in the figures.

The impact absorbing liner 8 can be made, in a known manner, of a collapsible material chosen in the group comprising EPS (expanded polystyrene), EPU (expanded polyurethane) or EPP (expanded polypropylene) for absorbing the energy of an impact.

The impact absorbing liner 8 is preferably made of EPS and has a thickness greater than the thicknesses of the outer shell 6 and of the comfort liner 10 for better absorbing the impact force, as shown in the cross section view of FIG. 2.

As already indicated above, the impact absorbing liner 8 may undergo a plastic deformation until it is flattened for 50% or more of its normal thickness for absorbing the impact. The comfort liner 10 in turn comprises an inner surface 18 designed to be in contact with the user's head H when the helmet 1 is worn by the user (see FIG. 2) and an outer surface 20 opposite to the inner surface 18 and facing the inner surface 22 of the impact absorbing liner 8 (see FIG. 2). Thus, the impact absorbing liner 8 is interposed between the outer shell 6 and the comfort liner 10.

The purpose of the comfort liner 10 is that of allowing the helmet 1 to rest comfortably on the head H of the wearer and it can be made of a soft material, as for example fabric or textile. It may also comprise an inner lining, not shown in the figures, for improving the comfort of the wearer.

Figure 4:
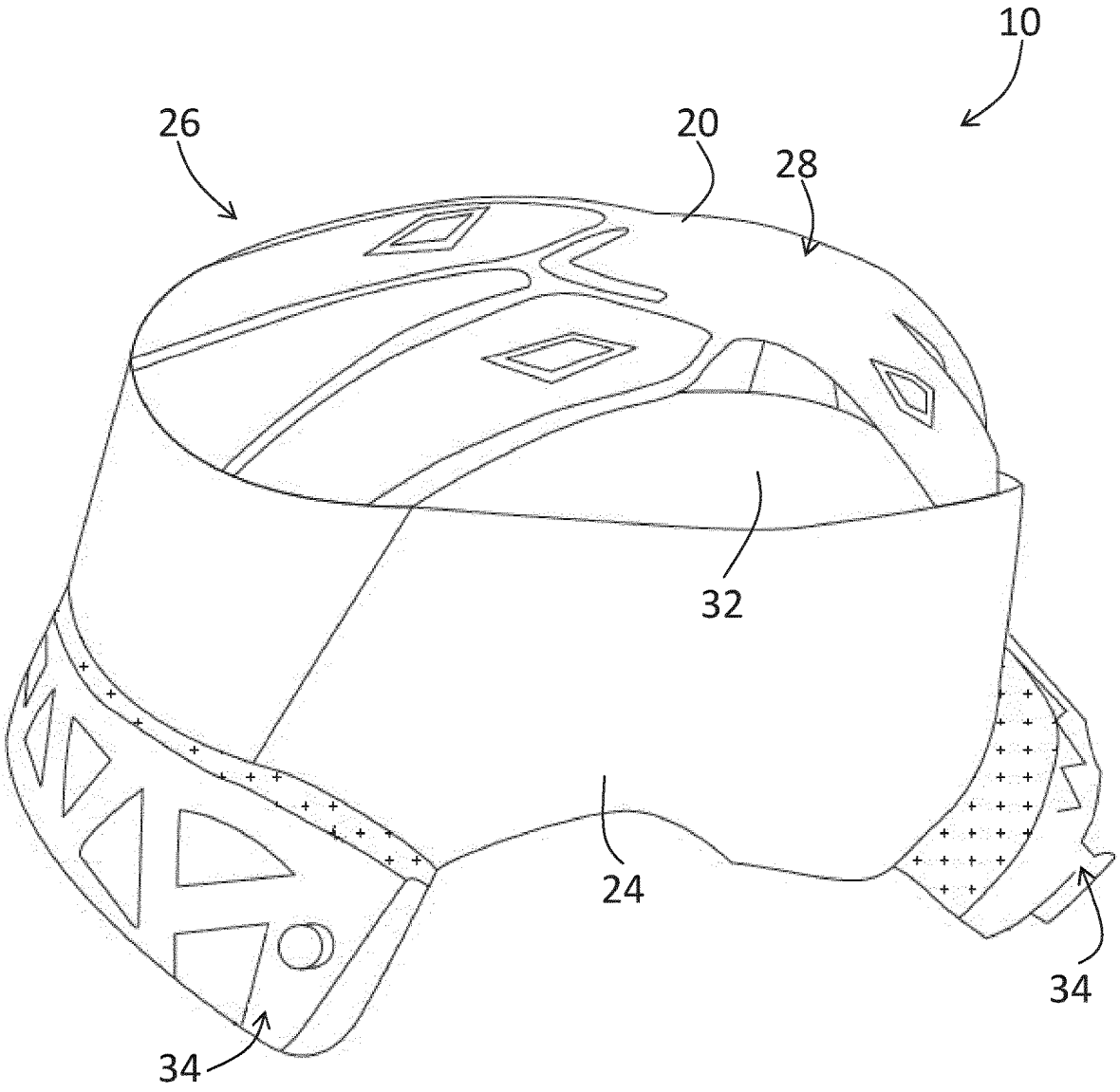
FIG. 4 shows a perspective view of an element of the helmet according to the present invention.

As shown in FIG. 4, the comfort liner 10 may have a dome shape. The comfort liner 10 can comprise a crown pad 24, adapted for encompass the side parts of the user's head H, and a top pad 26, adapted for covering and coming in contact with the top part of the user's head H.

In particular, the top pad 26 may comprise a central portion 28 intended to remain in contact with the user's head H and having appendages connected to the crown pad 24. The top pad 26 is adapted to be stretched and deformed relative to the crown pad 24 upon receiving an impact.

The central portion 28 of the top pad 26, in particular its appendages, can be fastened to the crown pad 24 by means of elastic bands, not shown in the figures. Furthermore, radial openings 32 can be provided between the top pad 26 and the crown pad 24, as shown in FIG. 4.

Thus, the above indicated surface 20 of the comfort liner 10 is formed by the outer surface of the crown pad 24 and by the outer surface of the top pad 26.

Figure 3:
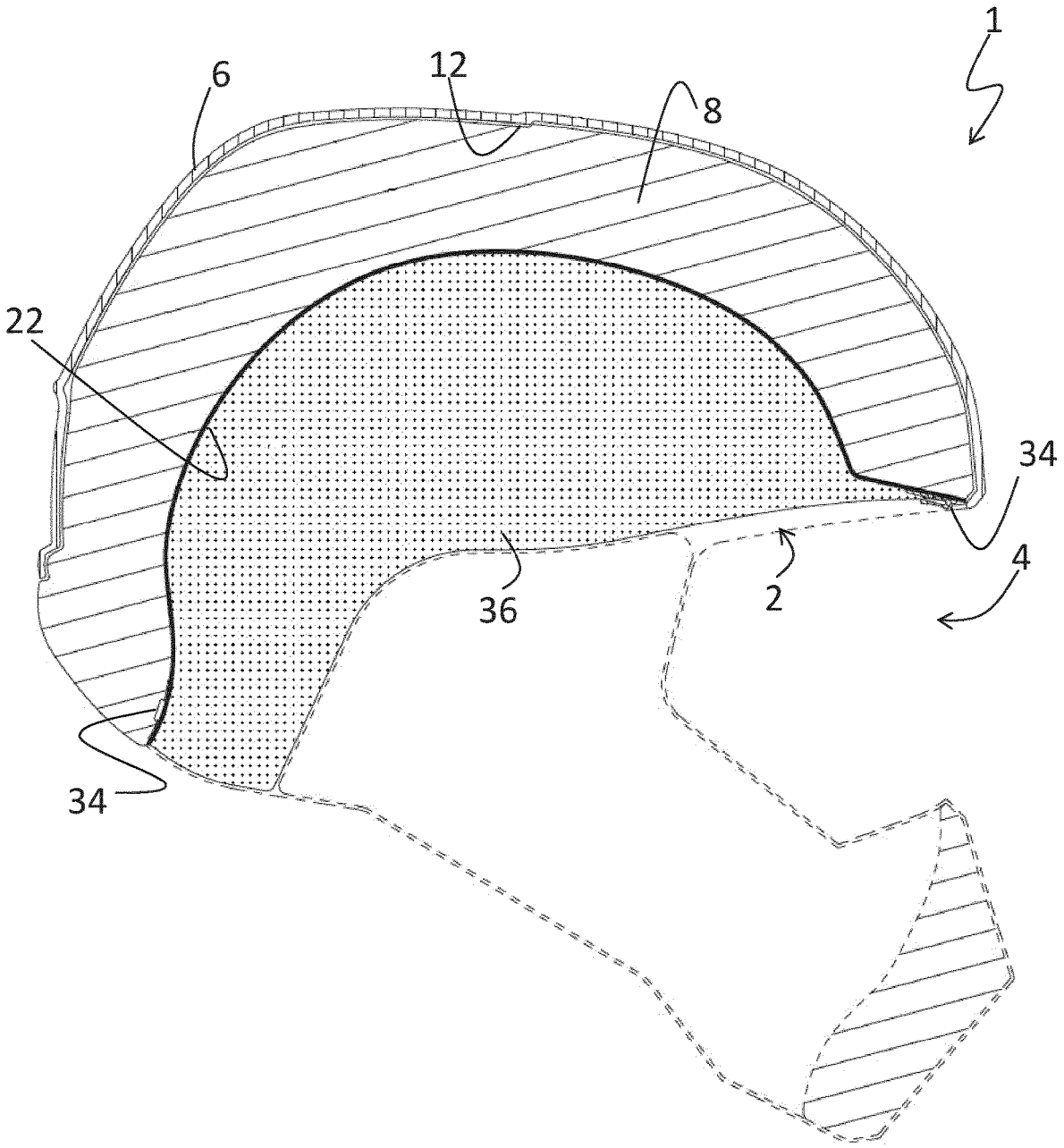
FIG. 3 shows a cross-sectioned side view of the helmet similar to that of FIG. 2 wherein the head of the user and the comfort liner are not shown.

The comfort liner 10 can be removably fixed to the impact absorbing liner 8 by suitable fixing means 34, better illustrated in FIGS. 2 to 4.

According to the present invention, the inner surface 22 of the impact absorbing liner 8 comprises at least one layer 36 made of an epoxy resin. This layer 36 in use is in contact with the comfort liner 10, in particular with its outer surface 20, and more in particular with the outer surface of the crown pad 24 and the top pad 26. The layer 36 of epoxy resin is better shown in FIGS. 2 and 3, in particular in FIG. 3.

Thus, the layer of epoxy resin 36 is positioned between the impact absorbing liner 8 and the comfort liner 10 in turn fixed inside the helmet 1.

The main function of the layer of epoxy resin 36 is that of allowing the helmet 1 to better absorb the radial impacts acting on the user's head.

As a matter of fact, the layer 36 co-operates to distribute the impact force over a wider area of the impact absorbing liner 8, thus reducing the translational acceleration of the helmet 1. Moreover, it has been found that the provision of the layer 36 of epoxy resin at the inner surface 22 of the impact absorbing liner 8 allows to create an interface which does not hinder the mutual displacement between the impact absorbing liner 8 and the comfort liner 10, in particular in case of an oblique impact, and thus the mutual displacement between the head H of the user and the impact absorbing liner 8.

Advantageously, the layer of epoxy resin 36 allows the helmet 1 to partly reduce the rotational acceleration normally acting on the user's head H and brain during an oblique impact. In this way, the risk to have brain damage in case of an oblique impact is at least partly reduced.

In this regard, it is worth noting that other materials, as for example polycarbonate and acrylonitrile butadiene styrene, are not suitable to be used in replacement of the epoxy resin as they do not have both the technical effects indicated above.

As a matter of fact, the epoxy resin of the present invention is a thermosetting polymer, whereby it could be not injected, while the other above mentioned materials are all thermoplastic materials.

Further, the layer 36 of the epoxy resin allows to have an uniform and regular inner surface 22 of the impact absorbing liner 8, with respect to the case in which the inner surface is not coated with any layer.

As it can be seen from the figures, in particular from FIG. 3, the resin layer 36 covers all the inner surface 22 of the impact absorbing liner 8. In alternative, according to a further embodiment not shown in the figures, the layer 36 of epoxy resin may only partially cover the inner surface 22 of the impact absorbing liner 8.

Preferably, the layer of epoxy resin 36 can be applied to the inner surface 22 of the impact absorbing liner 8 by means of an air or airless sprayer. In alternative, the layer of epoxy resin 36 can be applied to the inner surface 22 of the impact absorbing liner 8 by means of a brush or a foam roller.

Regardless the method used for applying the epoxy resin on the inner surface 22 of the impact absorbing liner 8, the layer of epoxy resin 36 has preferably a thickness comprised between 0.08 mm and 0.2 mm.

Advantageously, the application of the epoxy resin on the inner surface 22 of the impact absorbing liner 8 may envisage the application of a plurality of layers of epoxy resin 36, one above the other.

In this way, the thickness of the applied layer 36 of epoxy resin can be adjusted within the above indicated range according to the operational requirements, by varying the number of layers of epoxy resin applied on the inner surface 22 of the impact absorbing liner 8.

The epoxy resin is a thixotropic resin which is obtained by the reaction between a base component to be cross-linked and a hardener, acting as catalyst.

Preferably, the epoxy resin has a hardness comprised between 60 and 70 Shore D measured according to standard ASTM D2240 and a viscosity comprised between 3800 and 4200 mPa·s measured according to standard ASTM D2393.

Further, the friction coefficient of the epoxy resin is not so high, whereby the layer of epoxy resin 36 does not hinder the mutual displacement between the comfort liner 10 and the impact absorbing liner 8.

Hereinafter, a comparison table is provided reporting the values of the peak linear acceleration (PLA) and the peak rotational acceleration (PRA) measured for different impact points on a helmet comprising an impact absorbing liner without the layer of epoxy resin and on a helmet comprising an impact absorbing liner coated with the epoxy resin layer.

| | | Without epoxy resin | With epoxy resin | Difference |
|---|---|---|---|---|
| PLA(g) | P+ | 138.5 | 140 | 1.08% |
| | R+ | 199 | 178 | −10.55% |
| | P− | 174 | 149 | −14.37% |
| | R− | 180 | 164.5 | −8.61% |
| PRA (rad/s$^2$) | P+ | 5149 | 3758 | −27.01% |
| | R+ | 6933 | 4654 | −32.87% |
| | P− | 7580 | 6201 | −18.20% |
| | R− | 7622 | 4314 | −43.41% |

In the above table, the references P+, R+, P−, R− identify the different impact points on the helmet, in particular:

P+ identifies an impact on the rear part of the helmet;

P− identifies an impact on the front part of the helmet;

R+ identifies an impact on the right part of the helmet;

R− identifies an impact on the left part of the helmet.

Impact tests have been performed by using standard equipment and procedures known in the related technical field.

From the above table it can be noticed that the peak values of linear acceleration and rotational acceleration of the helmet comprising the layer of epoxy resin are considerably reduced with respect to the values of linear acceleration and rotational acceleration of the helmet without the layer of epoxy resin.

Thus, it can be assessed that the helmet of the present invention efficiently reduces the linear acceleration acting on the user's head, thereby improving the impact absorption of the helmet.

Moreover, unexpectedly, it can be assessed that the helmet of the present invention is also effective in reducing the rotational acceleration acting on the user's brain in case of an oblique impact.

The present invention also covers a method for applying a layer of epoxy resin 36, of the type as described above, on an impact absorbing liner 8 of a helmet 1, in particular on its inner surface 22.

Preferably, the step of applying the layer of epoxy resin 36 on the inner surface 22 of the impact absorbing liner 8 is performed by air or airless spraying of the layer of epoxy resin. In alternative, the layer of epoxy resin 36 can be applied by means of a brush or a foam roller.

At this point of the disclosure it is clear how the predefined objects are achieved with the helmet provided with the layer of epoxy resin according to the invention.

As a matter of fact, a layer of epoxy resin applied on the impact absorbing liner and having the features indicated above allows the helmet to better absorb both normal impacts and oblique impacts.

Furthermore, the epoxy resin layer does not hinder the mutual displacement between the impact absorbing liner and the comfort liner, and thus it somehow manages to reduce the rotational acceleration caused by oblique impacts.

With regard to the embodiments of the helmet device described above, the person skilled in the art may, in order to satisfy specific requirements, make modifications to and/or replace elements described with equivalent elements, without thereby departing from the scope of the accompanying claims.

For example, the skilled person could change the shape of the comfort liner or provide different means for fixing the comfort liner to the impact absorbing liner, without prejudice to the scope of protection of the present invention.

The invention claimed is:

1. A protective helmet designed to be worn by a user and to protect the head of the user during an impact, such a helmet comprising:

a rigid outer shell;

a comfort liner having an inner surface designed to be in contact with the user's head when the helmet is worn by the user and an outer surface opposite to the inner surface; and an impact absorbing liner interposed between said rigid outer shell and said comfort liner and having an inner surface facing the outer surface of the comfort liner;

characterized in that the inner surface of said impact absorbing liner comprises at least one layer made of an epoxy resin in contact with the comfort liner in use.

2. The protective helmet according to claim 1, characterized in that said at least one layer of epoxy resin (has a thickness comprised between 0.08 mm and 0.2 mm.

3. The protective helmet according to claim 1, characterized in that said epoxy resin has a hardness comprised between 60 and 70 Shore D.

4. The protective helmet according to claim 1, characterized in that said epoxy resin has a viscosity comprised between 3800 and 4200 mPa·s.

5. The protective helmet according to claim 1, characterized in that the inner surface of the impact absorbing liner comprises a plurality of layers of epoxy resin applied one above the other.

6. The protective helmet according to claim 1, characterized in that said comfort liner has a dome shape.

7. The protective helmet according to claim 1, characterized in that said comfort liner comprises a crown pad, adapted for encompassing the side parts of the user's head, and a top pad, adapted for covering and being in contact with the top portion of the user's head.

8. The protective helmet according to claim 1, characterized in that said comfort liner is made of fabric or textile.

9. The protective helmet according to claim 7, characterized in that said top pad comprises a central portion having appendages connected to the crown pad.

10. A protective helmet according to claim 1, characterized by comprising means for removably fixing said comfort liner to said impact absorbing liner.

11. A method for applying a layer of epoxy resin on an impact absorbing liner the protective helmet according to claim 1, characterized in that the step of applying the layer of epoxy resin is performed by air or airless spraying.

12. A method for applying a layer of epoxy resin on an impact absorbing liner the protective helmet according to claim 1, characterized in that the step of applying the layer of epoxy resin is performed by means of a brush or a foam roller.

* * * * *